US005927215A

United States Patent [19]

Moriguchi

[11] Patent Number: 5,927,215

[45] Date of Patent: Jul. 27, 1999

[54] PREHEATER AND INCINERATION SYSTEM HAVING THE PREHEATER

[75] Inventor: Yaichiro Moriguchi, 12-25 Tsukuno-cho 2-chome, Sakai-shi, Osaka, Japan

[73] Assignee: Yaichiro Moriguchi, Japan

[21] Appl. No.: 08/937,460

[22] Filed: Sep. 25, 1997

[51] Int. Cl.[6] ..... F23G 5/04; F23G 5/02; F23K 3/00

[52] U.S. Cl. ..... 110/228; 110/224; 110/227; 110/235; 110/256; 110/257; 110/101 R; 110/115

[58] Field of Search ..... 110/101 R, 115, 110/118, 101 CF, 218, 219, 224, 227, 228, 235, 255, 256, 257, 259

[56] References Cited

U.S. PATENT DOCUMENTS

| | | | |
|---|---|---|---|
| 3,610,182 | 10/1971 | Stockman | 110/102 |
| 4,280,415 | 7/1981 | Wirguin et al. | 110/224 |
| 4,351,250 | 9/1982 | Chartrand et al. | 110/218 X |
| 4,434,724 | 3/1984 | Kunkel, Jr. | 110/269 |
| 4,539,917 | 9/1985 | Mallon et al. | 110/256 |
| 4,656,956 | 4/1987 | Flickinger et al. | 110/233 |
| 5,195,449 | 3/1993 | Michimae | 110/257 |
| 5,226,375 | 7/1993 | Fukuda | 110/346 |
| 5,231,936 | 8/1993 | Kikuchi et al. | 110/224 |
| 5,269,233 | 12/1993 | Johnson et al. | 110/101 CF X |
| 5,769,009 | 6/1998 | Saitoh | 110/259 |

*Primary Examiner*—Ira S. Lazarus
*Assistant Examiner*—Ljiljana V. Ciric
*Attorney, Agent, or Firm*—Fulbright & Jaworski L.L.P.

[57] ABSTRACT

A preheater in an incineration system consists of: a first opening through which refuse is input; a second opening which is formed under the first opening and communicates with an incinerator; a heat flow passageway which is formed between the first and second openings, and passes the heat generated by the incinerator; and a receiving unit between the two openings which rotates the refuse in the heat flow passageway.

4 Claims, 4 Drawing Sheets

PREHEATER AND INCINERATION SYSTEM HAVING THE PREHEATER

BACKGROUND OF THE INVENTION

1. Field of the Invention

The present invention relates to a preheater and an incineration system having the preheater. Specifically, this invention is a preheater and an incineration system having the preheater for an efficient incineration of refuse containing moisture.

2. Discussion of Related Art

Many kinds of incineration systems have been developed, based upon the idea that incineration efficiency can be improved by heating and drying refuse before putting it into an incinerator. For example, there is a multi-staged incineration method of preheating and drying refuse in a special place (treatment chamber) before putting the refuse into the incinerator.

However, since a preheater according to prior art cannot sufficiently dry refuse containing much moisture, such as grass which has just been mowed, timber containing much water, and kitchen refuse, the incineration cannot be efficiently carried out. Additionally, since the conventional preheater is structured on a large scale, its equipment cost is very expensive. A standard small incineration system is not equipped with such the preheater.

SUMMARY OF THE INVENTION

Accordingly, the present invention is directed to a preheater and an incineration system having the preheater that substantially obviates one or more of the limitations and disadvantages of the related art.

An objective of the present invention is to provide a preheater and an incineration system having the preheater which, as a simple and high efficient apparatus, can be used even in a small incineration system and installed with a small outlay.

Additional features and advantages of the invention will be set forth in the description which follows, and in part will be apparent from the description, or may be learned by practice of the invention. The objectives and other advantages of the invention will be realized and attained by the structure as illustrated in the written description and claims hereof, as well as the appended drawings.

To achieve these and other advantages, and in accordance with the purpose of the present invention as embodied and broadly described, a preheater in an incineration system includes: a first opening through which the refuse is input; a second opening which is formed under the first opening and communicates with an incinerator; a heat flow passageway which is formed between the first and second openings and passes the heat generated by the incinerator; and a receiving unit which rotates when the refuse is put into the heat flow passageway to send down the refuse.

The preheater of the present invention shuts the heat generated by the incinerator up to use the heat for efficiently drying the refuse, thereby decreasing the time required for incineration and sufficiently incinerating the refuse with a small amount of heat. When the refuse is input through the first opening and passes through the heat flow passageway, the receiving unit makes the refuse stay in the heat flow passageway and exposed to heat ascending along the heat flow passageway, thus allowing the heat generated by the incinerator to be used for desiccation of the refuse. Compared to a conventional plate installed in the heat flow passageway as an obstacle, the rotary receiving unit makes the refuse stay in the heat flow passageway longer, thus allowing the thorough desiccation of the refuse.

When the receiving unit includes a plate which is profiled to fit the inside diameter of the heat flow passageway, and a drive unit which is connected to the central axis of the plate and rotates the plate around the axis, the above objective can be achieved better. The structure described above allows the refuse to be dried sufficiently well in the heat flow passageway. The drive unit rotating the plate controls the rotation speed of the plate and the desiccation time according to the kinds of incineration refuse, thereby carrying out efficient heating and desiccation.

It is more preferable to install multiple receiving units in the heat flow passageway and to connect the multiple receiving units to the drive unit using transfer units. In such the structure, the pieces of refuse are located at different places in the heat flow passageway for a predetermined time, using the multiple receiving units, thereby making the refuse stay longer in the heat flow passageway, which contains sufficient heat and accelerates the desiccation of the refuse.

To achieve the above objective, the incineration system of the present invention includes: the preheater described above; an opening end connected with the second opening of the preheater; a heating unit for heating the refuse; and an outlet for discharging refuse after incineration.

According to the incineration system of the present invention described above, heat for heating the refuse can be effectively used, thus an incineration system of high thermal efficiency can be provided.

It is desirable to install a conveyance device for receiving the refuse which is delivered through the heat flow passageway of the preheater, and putting it into the incinerator from one end distant away from the rising heat flow outlet in the incinerator. Through this structure, the dropping refuse is prevented from blocking up the rising heat flow outlet, thus a rising path for heat can be secured.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF PREFERRED EMBODIMENT

Reference will now be made in detail to the preferred embodiments of the present invention, examples of which are illustrated in the accompanying drawings.

With reference to the attached drawings, preferred embodiments of the present invention are described below in detail.

Figure 1:
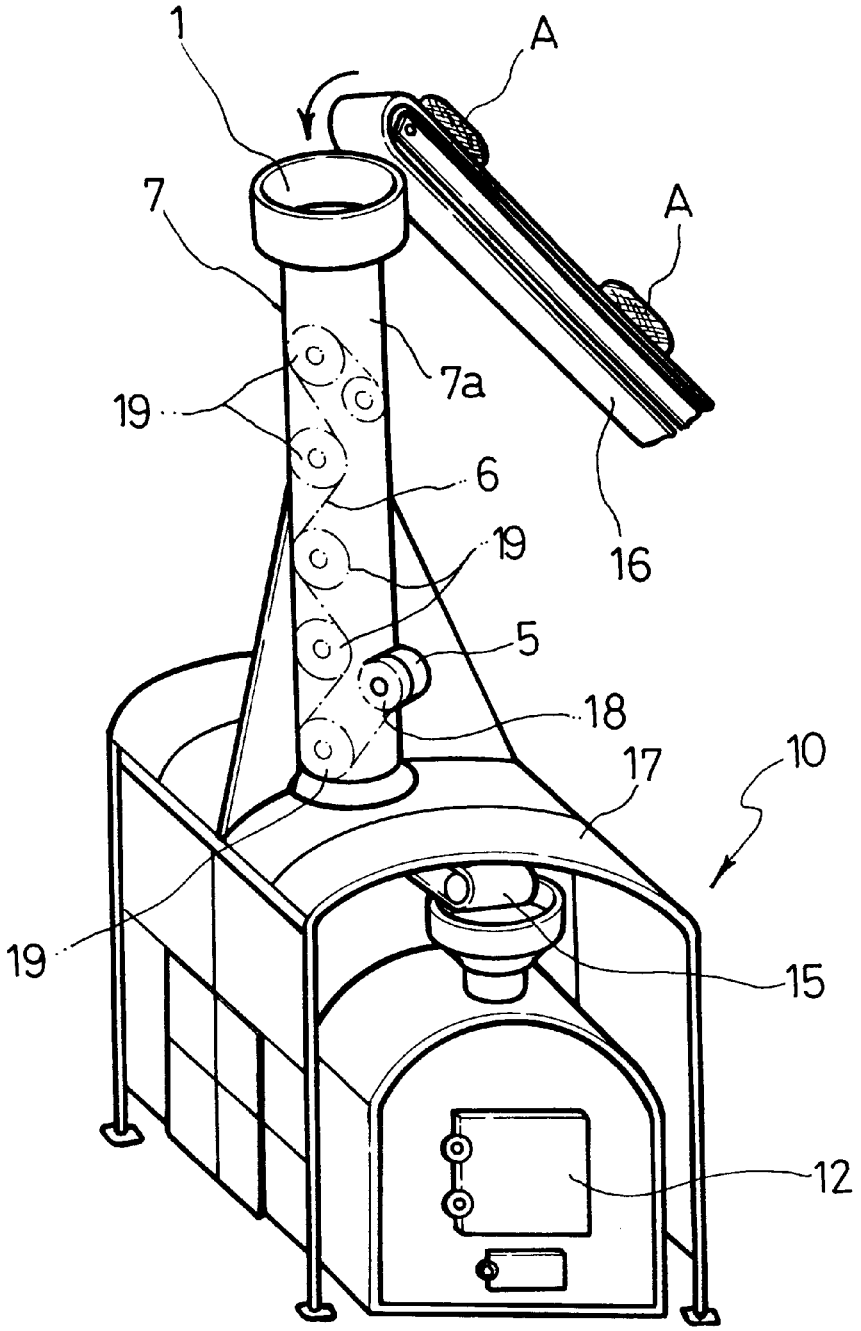
FIG. 1 is a perspective view of an incineration system having a preheater according to one preferred embodiment of the present invention.
Figure 2:
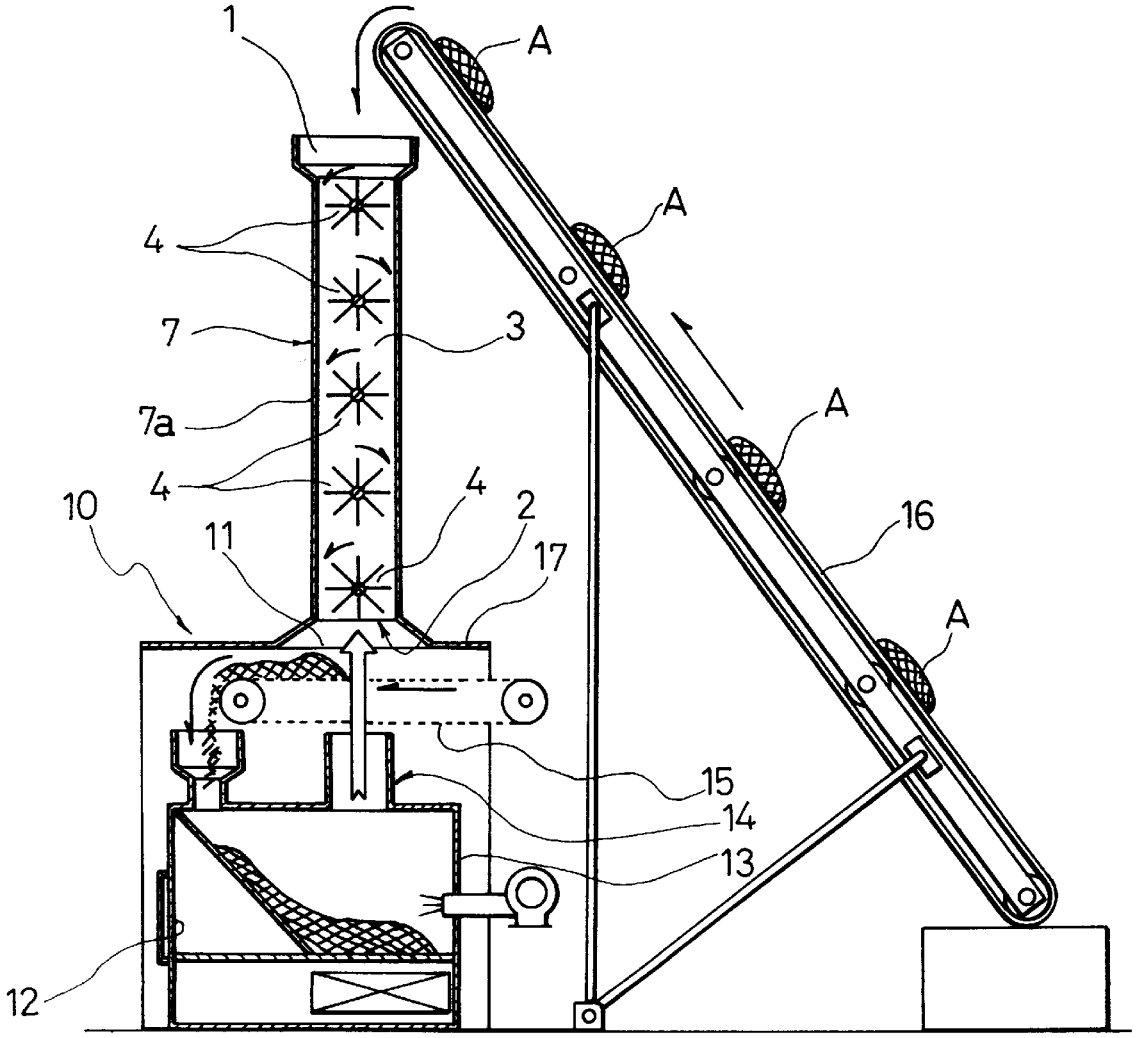
FIG. 2 is a vertical section of an incineration system having a preheater according to one preferred embodiment of the present invention.

As shown in FIGS. 1 and 2, incineration system 10 having a preheater according to the preferred embodiment of the present invention consists of: housing 17 for covering a mechanical device; and preheater 7 standing uprightly therefrom. Preheater 7 includes cylindrical main body 7*a*. First opening 1 for receiving the refuse, A, is formed on the top of main body 7*a*. The refuse, A, such as grass, is carried to first opening 1 by belt conveyer 16. Belt conveyer 16 is not indispensable, but it is useful in sequentially treating mass refuse, A.

Figure 4:
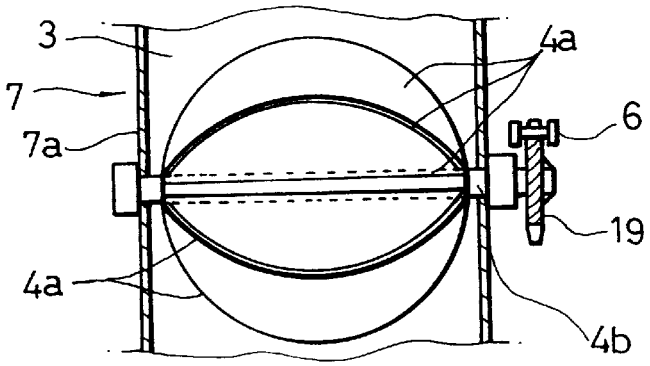
FIG. 4 is a partially enlarged transverse cross section of a receiving unit according to one preferred embodiment of the present invention.
Figure 5:
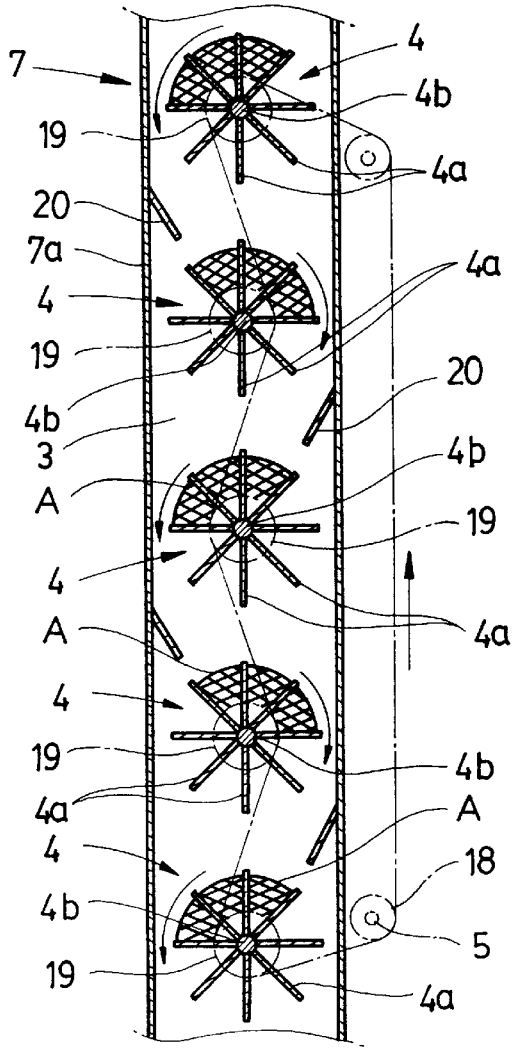
FIG. 5 is a vertical section of a preheater according to another preferred embodiment of the present invention.

Refuse, A, sequentially drops from first opening 1 toward an incinerator. Multiple (about five) receiving units 4 are installed in heat flow passageway 3 of preheater 7 and slowly rotate. Dropping refuse, A, is stopped by plate 4*a* of receiving unit 4. As shown in FIG. 4, eight plates 4*a* are installed around central axis 4*b* of receiving unit 4. Each plate is a semicircle shaping to the cylindrical main body 7*a*. Plate 4*a* must be shaped to the cross sectional profile of main body 7*a* not to drop refuse, A, through the gap between plate 4*a* and main body 7*a*. For example, if the cross section of main body 7*a* is an edged figure, plate 4*a* must be the edged figure, and if the cross section of main body 7*a* is an oval, plate 4*a* must be the oval, to make the gap between the inner surface of main body 7*a* and plate 4*a* narrower.

Figure 3:
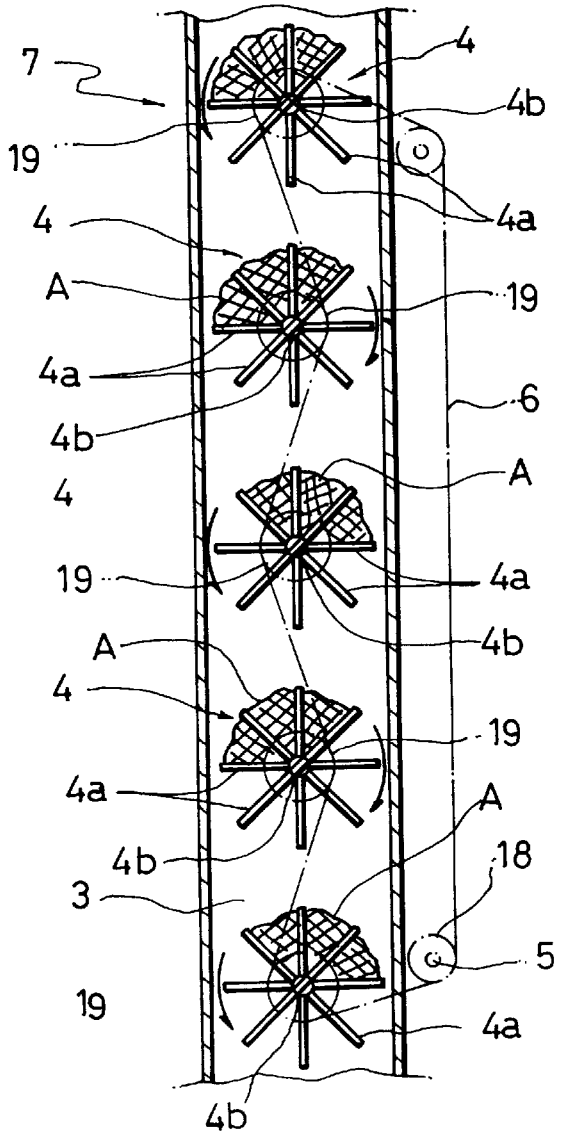
FIG. 3 is a vertical section of a preheater according to one preferred embodiment of the present invention.

The numbers of receiving units 4 and plates 4*a* are determined according to the amount, property, and form of refuse, A, or the scale of an incineration system. Rotation frequency of receiving unit 4 is determined according to the property, form, moisture content, and moisture adsorption of refuse A. For example, if refuse A is grass which has just been mowed, 1 RPM is enough. If refuse A gets wet in the rain and contains much moisture, receiving unit 4 must be rotated slower. As shown in FIG. 3, receiving units 4 are rotated in the opposite direction to each other by a chain, which is a kind of a transfer unit or power transfer means, thus refuse, A, does not lean to one side, and stays longer in heat flow passageway 3. Transfer unit 6 does not need to be limited to the chain. A belt or other means can be used as transfer unit or power transfer means 6.

A motor, which is used as drive unit 5 against the chain used as transfer unit 6, is installed at the outer lower part of main body 7*a* in preheater 7. Once working roller 18 is rotated by the motor, or drive unit 5, the chain winding around working roller 18 rotates driven roller 19. The chain winds around driven rollers 19 of each receiving unit in an alternate left/right direction, thus receiving units 4 rotate in the opposite direction to each other. This structure allows refuse, A, to stay as long as possible, and to be sufficiently dried. Refuse A, which is rather dried before dropping from the lowest part of main body 7*a* of preheater 7 to an incinerator through opening end 11, drops on a conveyer, not to rising heat flow outlet 14 of incinerator 13. The refuse is then carried to the one end of the incinerator by the conveyer, which is conveyance unit 15 for delivering refuse horizontally. Through the above structure, refuse A is well dried while passing through preheater 7, and does not hinder the rise of heat flow from incinerator 13. The elements and structure described above also make it possible to conveniently treat mass refuse, A.

This incineration system is designed to cover incinerator 13 with housing 17, but housing 17 is dispensable. Any apparatus having an incineration function (a gas or electric heating type, or an apparatus where kindling is input through an opening) can be used regardless of its structure. The remains generated after the refuse A is incinerated by the incinerator is discharged through outlet 12 of incinerator 13. If the discharged remains is carbonized, it can be utilized as a fertilizer.

The description of another preferred embodiment of the present invention will be set forth.

It is more desirable to narrow the gap between main body 7*a* and plate 4*a*, but it is more efficient to increase the area of heat flow passageway when refuse, A, is not very small. One method for this case is to space main body 7*a* and plate 4*a* in some distance, and install guides 20 properly formed between receiving units 4, to lead refuse, A, to lower receiving units. Another method is to insert a porous pipe into the gap between main body 7*a* and plate 4*a*.

If refuse, A, like a lump solid body, is input to preheater 7 through first opening 1, the refuse strikes the hem or surface of plate 4*a* and is broken into pieces. To efficiently break the solid body, the hem of plate 4*a* can be made sharp or form any other shapes.

This incineration system is not limited to processing refuse such as grass or garbage. It can be widely used to dispose of refuse such as coffee grounds, dregs generated when squeezing juice from fruit, remains of vegetable or waste generated when processing food, leaves or pieces of trees, or waste from livestock. The incineration system of the present invention is very effective in treating refuse containing much moisture. It is desirable to install a deodorization device when treating the waste from livestock. A combustion deodorization device can be implemented by forming a large hole in the middle of main body 7*a* in preheater 7, and installing a combustion device in the hole. There is also another method of installing a water tank on the extended line of main body 7*a*, and discharging smoke after making it pass through the water tank. However, the deodorization device is not limited to a specific type. If there is a possibility of generating poisonous gas, an exhaust processing unit must be installed.

In the preferred embodiment of this invention, plate 4*a* forming receiving unit 4 is flat, and its central axis 4*b* makes a right angle to the axis of heat flow passageway 3. However, both the axes can be crossed at other angles, not at the right angle. Plate 4*a* can be designed to have a sunk center, or a curved surface. In another embodiment, plate 4*a* is made flat, and central axis 4*b* of the top receiving unit crosses the axis of heat flow passageway 3 at an angle of some degrees. Lower receiving units are installed in the same way, making a multistage apparatus. This structure makes refuse A form a spiral drop path, thereby allowing refuse A to stay longer in heat flow passageway 3.

Figure 6:
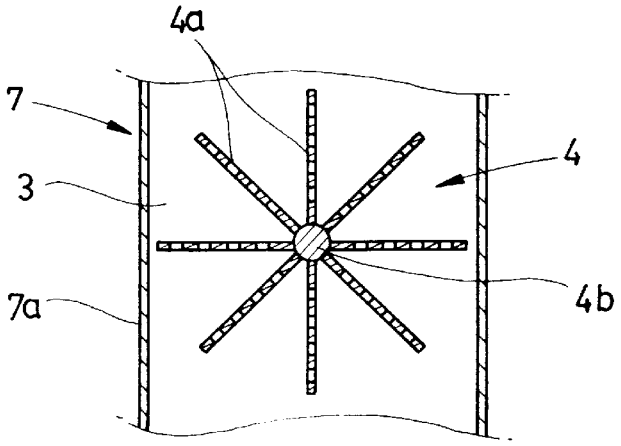
FIG. 6 is a partially enlarged transverse cross section of a receiving unit according to another preferred embodiment of the present invention.

A punching metal plate having holes on its surface can be used as plate 4*a* of the receiving unit according to another embodiment of the present invention as shown in FIG. 6. Control unit for controlling the rotation speed of receiving unit 4 can be installed. The width, length, number, and shape of preheater 7 depend upon the scale of incineration system. To increase heat efficiency of preheater 7, main body 7*a* of preheater 7 can be coated with insulation.

As illustrated, the present invention can provide a simple and high efficient preheater, which can be used in a small incineration system and installed with a small outlay, and an incineration system having the preheater.

It will be apparent to those skilled in the art that various modifications and variations can be made in a preheater and incineration system having the preheater of the present invention without deviating from the spirit or scope of the invention. Thus, it is intended that the present invention cover the modifications and variations of this invention provided they come within the scope of the appended claims and their equivalents.

What is claimed is:

1. A preheating apparatus in an incineration system for refuse, comprising:

a first opening through which refuse is input;

a second opening formed under the first opening and communicating with an incinerator in the incineration system;

a heat flow passageway formed between the first and second openings, and passing heat generated by the incinerator; and multiple receiving units sequentially installed along the central axis of and within the heat flow passageway, said multiple receiving units each comprising at least two plates and being rotatable in opposite directions to each other and also being connected to power transfer means for receiving power from a drive means, whereby said units rotate when the refuse is put into the heat flow passageway.

2. The apparatus according to claim 1, wherein at least one of the receiving units comprises at least one plate which is profiled to fit the inside diameter of the apparatus, and drive means which is connected to the central axis of the at least one plate for rotating the at least one plate around the axis.

3. An incineration system for refuse, comprising:

a preheating apparatus, said preheating apparatus comprising a first opening through which refuse is input; a second opening formed under the first opening and communicating with an incinerator in the incineration system; a heat flow passageway formed between the first and second openings and passing heat generated by the incinerator; and multiple receiving units sequentially installed along the central axis of and within the heat flow passageway, said multiple receiving units each comprising at least two plates and being rotatable in opposite directions to each other and also being connected to power transfer means for receiving power from a drive means, whereby said units rotate when the refuse is put into the heat flow passageway;

heating means for heating the refuse by providing heat to the heat flow passageway; and an outlet for discharging incinerated refuse.

4. The system according to claim 3, further comprising conveyance means for receiving refuse delivered through the heat flow passageway of the preheating apparatus, and for putting the refuse into the incinerator at one end distant from an area from which heat is provided to the heat flow passageway.

* * * * *